US005205552A

United States Patent [19]

Green, Jr.

[11] Patent Number: 5,205,552

[45] Date of Patent: Apr. 27, 1993

[54] SWINGWEIGHTED METALWOOD GOLF CLUB AND METHOD OF ASSEMBLY THEREOF

[76] Inventor: Robert Green, Jr., 9041 Puesta del Sol, Desert Hot Springs, Calif. 92240

[21] Appl. No.: 887,863

[22] Filed: May 26, 1992

Related U.S. Application Data

[63] Continuation-in-part of Ser. No. 709,117, Jun. 3, 1991.

[51] Int. Cl.[5] ..... A63B 53/02

[52] U.S. Cl. ..... 273/808; 273/80.2; 273/80.3

[58] Field of Search ..... 273/80 R, 80.1-80.5, 273/80.8, 167 K, 167 H, 169, 80.9, 80 A-80 D

[56] References Cited

U.S. PATENT DOCUMENTS

| | | | |
|---|---|---|---|
| 2,231,847 | 2/1941 | Dickson et al. | 273/80.8 |
| 2,463,053 | 3/1949 | Pritchard | 273/80.1 |
| 3,170,691 | 2/1965 | Pritchard | 273/80.5 |
| 3,572,709 | 3/1971 | Risher | 273/80.2 |
| 3,825,991 | 7/1974 | Cornell | 273/80.2 |
| 4,438,931 | 3/1984 | Motomiya | 273/80.2 |

*Primary Examiner*—William H. Grieb
*Assistant Examiner*—Steven B. Wong
*Attorney, Agent, or Firm*—I. Louis Wolk

[57] ABSTRACT

The invention relates to the incorporation of swingweights within the club heads of metalwood golf clubs of the type in which the head is formed of a metal shell which encloses a rigid cellular core, wherein a weight in the form of an elongated cylinder is inserted into an opening formed in alignment with the shaft and hosel depending from the base of the hosel into said opening and is affixed at its upper end to a hollow club shaft.

3 Claims, 1 Drawing Sheet

FIG. 1
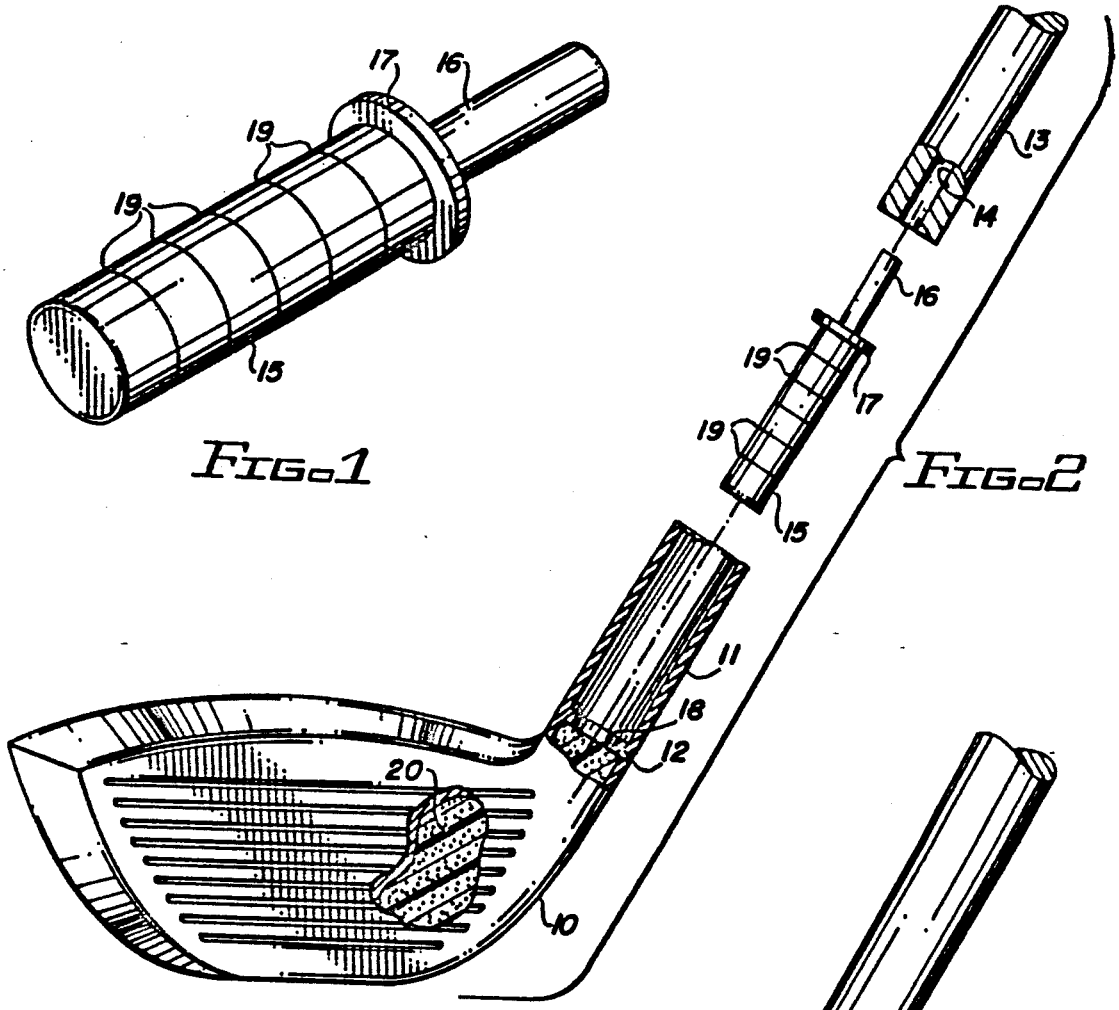
FIG. 2
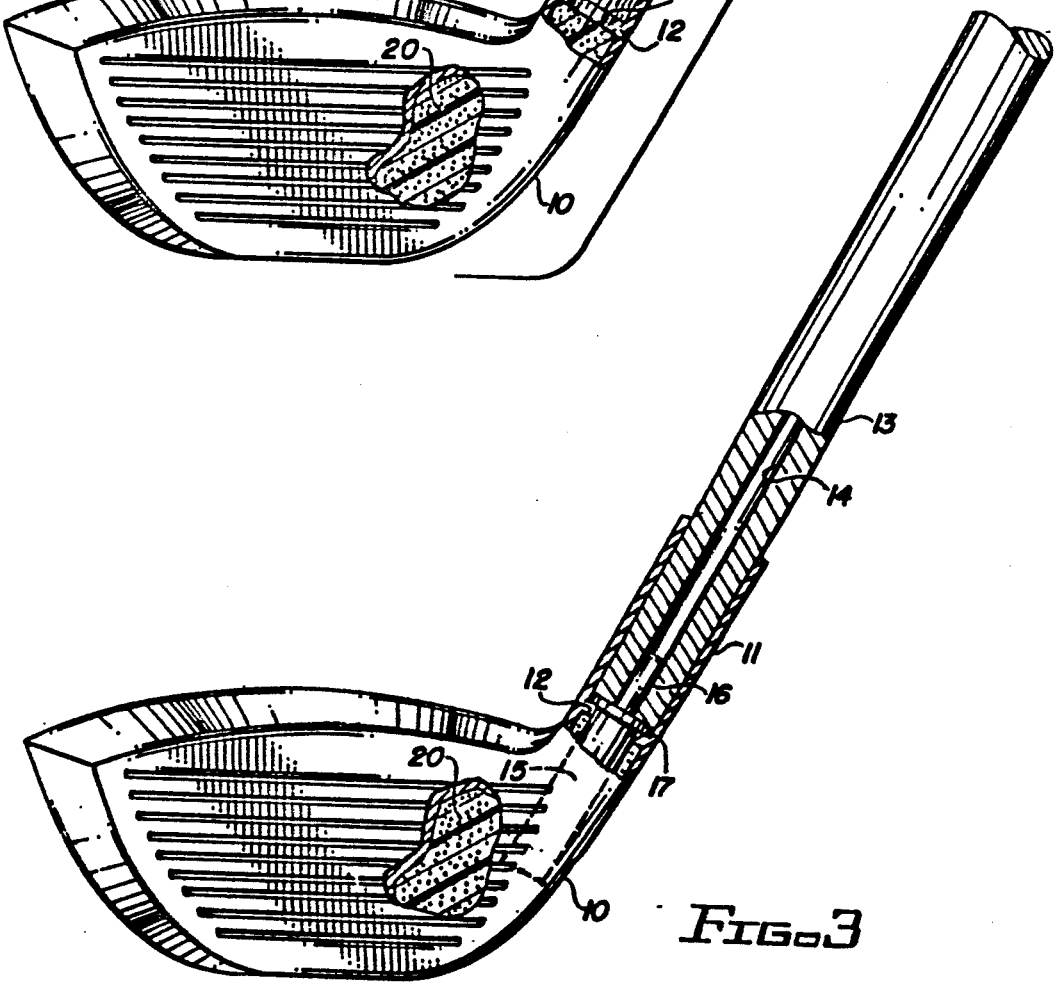
FIG. 3

SWINGWEIGHTED METALWOOD GOLF CLUB AND METHOD OF ASSEMBLY THEREOF

This application is a continuation, in part, of my pending application Ser. No. 709117, filed Jun. 3, 1991.

BACKGROUND OF THE INVENTION

This invention is directed to the swing weighting of clubheads of metalwood clubs, which are so designated in the golf world. These clubs have become popular alternatives to or as replacements for the conventional so-called "wood" clubs.

The "metalwood" clubs are so called because the heads are in fact formed essentially of a metal shell most commonly as a cast metal shell filled with a rigid plastic foam. One method used in the manufacture of such clubheads involves lost wax investment casting of a metal shell and the injection thereinto of a rigid foam-forming composition and allowing it to set. Such a composition may be of a rigid polyurethane foam or other foam materials such as carbon fibers, etc. Since such clubheads are often found to be too light, it has usually been found necessary to apply weights of predetermined size to such clubheads in order to properly adjust the swingweight of the clubhead to fit the player.

The term "swingweighting" refers to the application of a weight to the clubhead in order to properly match the clubhead to the flexing characteristics of the shaft, which may vary to a large extent depending on the club user and/or to the design of the club. Swingweight, as designated by the principal governing bodies in the field, namely, The Royal and Ancient Golf Club of Scotland and the U.S.G.A., identified in several categories in accordance with the physical characteristics of the shaft and whether for mens or ladies clubs. This has generally been accomplished by the use of lead tape applied at appropriate positions on the clubhead or on or near the club hosel, or by providing ports in the shell for the insertion of weights. Frequently such expedients require the redesign of the clubheads or shafts or result in an increase in shaft fracture.

SUMMARY OF THE INVENTION

In accordance with the present invention applicant has found that by incorporating his especially designed weight unit as an extension of and in effect as an added part or a replacement for the end portion of the shaft at the point where the shaft enters the clubhead, a predetermined added weight can be incorporated into the clubhead to achieve the desired degree of swingweighting while, at the same time, avoiding the undesired problems associated with present practices.

Thus in accordance with the present invention, this is accomplished by designing the weight unit in such a way that it can be incorporated into the heel region of the clubhead through the hosel of the club and formed to become integrated with the end of the shaft, whether graphite or steel, and also to extend downward to the heel of the club in alignment with the shaft. This design is such that nothing is changed in the design of the clubhead or shaft and the shaft flex and its function is not affected and the risk of fracture is minimized. In addition, the location of the weight brings the center of gravity towards the rear of the clubhead and greatly benefits the player who slices or has a bad fade. The resulting design thus permits its incorporation originally into the clubhead during manufacture or enables existing clubheads to be modified or repaired by the insertion of the described weight unit.

The weight unit which is described herein comprises a cylindrical member dimensioned to fit through the hosel of the club and be inserted within the clubhead in line with the shaft positioned within the heel area of the clubhead and within a drilled out area of the foam or other core of the clubhead. The hosel is an upward extension of the clubhead designed to retain and anchor the lower end of the club shaft, or where the shaft extends into the heel of the clubhead, the hosel provides support and reinforcement to anchor the shaft at the upper portion of the head. It is retained within the hosel by a shaft stop formed at the base of the hosel as a barrier between its core and as a means for engagement of the end of the shaft. The weight unit itself, which is preferably cylindrical, is engaged by a stop collar formed at its upper end which in turn engages the shaft stop at the lower end of the hosel. In order to provide firm engagement with the shaft, the weight unit is also provided at its upper end with an elongated narrow cylindrical extension dimensioned to fit into the shaft end and be cemented thereto.

The weight unit may be of any desired suitable material, usually a metal such as brass, lead, zinc, tungsten or the like or may be of a hard plastic reinforced with metal or carbon fiber particles depending on the weight desired. It may also be marked in graduated increments where it is to be inserted into a previously manufactured club so that it can be cut off to provide the desired weight for custom fitting. In addition, where the club assembly is designed to permit custom fitting for the purchaser, the clubhead, shaft and weight unit may be sold disassembled to be assembled by the seller or club pro.

The weight assembly described herein is designed for use with hollow steel or graphite shafts and finds special utility with the latter.

Applicant has become aware of U.S. Pat. No. 4,607,846 to Perkins, wherein a separate cylindrical weight is inserted into an opening in the shaft of a club as an auxiliary to lateral weights inserted into the top portion of the clubhead. The weight in the head is spaced from and separate from the shaft and extends into the hosel. Such a construction, which creates a potential for fracture between the club head and shaft is undesirable, especially for metalwood clubs. The weight distribution is incorrect since it extends into the hosel and the torque created by impact would cause the clubhead to flex and possibly fracture. Applicant's integration of the weight with the shaft as described is essential.

As described further herein this invention is primarily directed to the application of the described weighting system to metalwood clubheads in which the metal shell is injected with a plastic foam having a composition such that it sets in situ to a rigid cellular core structure. The shell has been cast to include an integral hosel extension across the base of which a barrier is formed which serves to enclose the core and at the same time act as a shaft stop. When the core is formed, a small opening is made in this barrier through which the foam is introduced.

When it is desired to introduce applicant's weight, the opening in the barrier is enlarged to a diameter sufficient to permit drilling of an opening downward toward the base of the shell at the heel in alignment with the hosel, said opening to be cylindrical and dimensioned to firmly accommodate the cylindrical weight upon insertion as described below.

BRIEF DESCRIPTION OF THE DRAWINGS

In the drawings:

FIG. 1 is a view in elevation of the weighting unit per se.

FIG. 2 is an exploded view in elevation of a clubhead weighting unit and shaft end prior to assembly.

FIG. 3 is a view in elevation of the assembled clubhead weighting unit and shaft partially opened to show the interior assembly.

DETAILED DESCRIPTION

As shown in FIGS. 2 and 3, clubhead 10 is of the metalwood type which consists of a cast metal shell surrounding a body of rigid plastic foam 20 which has been injected through an opening in a barrier 12 formed between the base of hosel 11 and the clubhead. This barrier is formed during casting in a position which will provide a predetermined stop point for the end of the shaft and a small opening is formed for the injection of the foam into the clubhead. This barrier serves as a shaft stop when the end of the shaft 13 is inserted into and bonded to the hosel. The shaft is tubular and may be formed of graphite or steel formed with passage 14. The weighting unit 15 is in the form of a cylinder of suitable weight and dimensions and is provided with an extension or shank 16 of smaller diameter designed to fit closely into shaft passage 14 to be bonded thereto by epoxy or other cement. A collar 17 is provided between 15 and 16 as shown which is of a slightly greater diameter in order to engage the shaft stop 12 during assembly. As shown, hosel 11 is hollow and provides a socket to receive shaft 14 which extends to the bottom of the hosel. The hosel extends upward from the top of the clubhead and serves to anchor the shaft which is bonded thereinto.

A typical procedure for assembly may be described as follows: Assuming that a pre-manufactured foam filled clubhead is provided, the original injection hole is drilled through the shaft stop 12 to form an opening 18 with a diameter sufficient to permit insertion of weighting unit 15 with collar 17 engaging shaft stop 12. This hole is drilled further into the foam and extends into the heel of the club for a sufficient depth to permit insertion of weighting unit 15 as shown. Generally, this hole extends downward into heel in alignment with the shaft all the way to the inside base of the shell.

For example, a standard hosel ID may be 0.335 in. Using a 19/64 drill bit, a passage is drilled through the shaft stop 12 into the interior of the clubhead along the line of the hosel into which unit 15 which has an O.D. of about 0.300 in. may be introduced as shown in FIG. 2. Before this is done, it is preferred to insert the small end 16 of the weight unit into the shaft end 14 and cement it in position. Unit 15 is then inserted and cemented in also. Cementing may or may not be necessary if frictional engagement is sufficient. The resulting structure as shown in FIG. 3 has the weighting unit positioned in the heel of the club in direct alignment with the shaft.

Where the weight unit is formed of brass, for example, the large end may have a length of 1¼" and weight about 15 grams which is equal to 7½ swing weights of 2 grams each. Where a lesser weight is desired, it can be trimmed off to provide the desired weight before assembly. Other metals of greater or lesser density will, of course, require suitable adjustment of the length of the unit. In order to provide firm engagement with the shaft, the small end 16 may, for example, have a length of ½" and an O.D. such that it will fit within the I.D. of a particular hollow shaft.

As shown in FIG. 3, the weighting unit 15 with it narrow end 16 and collar 17 may be provided with markings or graduations 19 to indicate swing weight components for removal according to the desired weight of the unit before assembly.

The maximum weight and length of the weight unit will change depending upon each manufacturer's design of the clubhead, which may increase or decrease the available distance between the shaft stop and the base of the shell. Also the hole drilled to receive the weight will usually extend the full distance, but where the weight is cut off as an adjustment, a small hollow space may remain between the bottom of the weight and the shell.

As discussed above, the invention described has numerous advantages:

1. It will eliminate the use of other types of swingweight parts in the clubhead.

2. It places the center of gravity of the clubhead more toward the heel of the club. This results in better playability because the clubhead always tends to rotate around the center of gravity.

3. It requires no change in the present design of clubheads and permits the use of their present configurations.

4. It provides repair shops with a simple method for swingweighting preexisting clubs of this type.

5. A further benefit is that this method of weighting helps the golfer who slices or fades the ball since the center of gravity is moved toward the heel of the club, thus causing less spin upon impact.

An example of a prior art type of metalwood club is shown in the patent to Motomiya, U.S. Pat. No. 4,438,931, in which the hollow shaft extends downward through the hosel to the bottom of the shell and is in fact welded thereto. It would not be possible to swingweight this club except by using core weights or tapes. Applicant's invention differs from this type of design by replacing that portion of the shaft which extends into the heel by a predetermined added weight which is greater than the original weight of that shaft portion and which is aligned with the shaft itself acting as an extension thereof. At the same time, the weight extension fulfills its desired function by imparting the desired added weight into the heel portion of the club. In this type, where the shaft extends down the heel from the hosel, there is of course no shaft stop at the base of the hosel. If it would be necessary to incorporate the above described weight in this type of club, it would be necessary to insert a ring at the base of the hosel to engage collar 17. The shaft would have to be cut off at its end and the weight inserted as described above. It is clear that this type of club cannot be swingweighted without using applicant's invention.

I claim:

1. A metalwood golf club which comprises a clubhead comprising a cast metal shell having a playing face with a heel and a hosel extending upwardly from said heel providing a shaft receiving socket, a hollow shaft positioned therein, a barrier at the base of said hosel forming with said shell an enclosure means for receiving a rigid foam forming material injected through an opening in said barrier to provide a rigid cellular core, said barrier also providing a stop for the end of said shaft, a swingweight incorporated into said core at said heel which comprises an elongated cylindrical weight unit having a predetermined weight, length and diameter, an opening in said barrier conforming to the diameter of said weight unit, a cylindrical opening, in said core in alignment with said opening and said hosel, said weight having a collar extending around its periphery at its upper end having a diameter slightly larger than the opening in said barrier to permit engagement therewith and an upwardly extending extension having an outer diameter conforming to the inner diameter of the hollow shaft, said weight being positioned within the said cylindrical opening in the heel of said clubhead with its collar in engagement with said barrier and with its upward extension affixed within the end of said tubular shaft thereby providing an added swingweight extending downward from said shaft and hosel in continuous alignment therewith into the heel of said clubhead.

2. A method for the incorporation of a predetermined added swingweight unit to a golf club head of the metal-wood type in which the clubhead is in the form of a metal shell enclosing a rigid non-metallic core, said head having a tubular shaft receiving hosel extending upwardly therefrom for engagement of a tubular hollow shaft, which comprises preforming a weighting unit in the form of an elongated cylinder having a predetermined weight with an upward extension for insertion into the bottom end of said shaft, providing a cylindrical opening in said core extending downward from the base of said hosel substantially to the base of said heel, said opening conforming substantially to the dimensions of said cylindrical member, inserting said upward extension of said cylindrical member into the base of said shaft and bonding it therein, inserting said cylindrical member and said shaft through said hosel with said cylindrical member extending downward within said opening into said heel, and bonding said shaft within said hosel, said hosel having a barrier at its base and said cylindrical opening is formed by drilling through said barrier downward into said core for a distance sufficient to accommodate said weight.

3. A method according to claim 2 wherein the non-metallic core is formed of a rigid cellular material.

* * * * *